United States Patent [19]

Lai

[11] Patent Number: 4,779,796

[45] Date of Patent: Oct. 25, 1988

[54] HEIGHT-ADJUSTABLE COLLAPSIBLE SWING STAND FOR GOLF TRAINING PURPOSE

[76] Inventor: Winston Lai, P.O. Box 10160, Taipei, Taiwan

[21] Appl. No.: 128,593

[22] Filed: Dec. 1, 1987

[51] Int. Cl.[4] ..... A63B 69/36; A63B 57/00

[52] U.S. Cl. ..... 273/195 B; 273/183 A; 273/202; 273/203

[58] Field of Search ..... 273/195 R, 195 B, 183 A, 273/203, 202

[56] References Cited

U.S. PATENT DOCUMENTS

| | | | |
|---|---|---|---|
| 2,941,808 | 6/1960 | Smith et al. | 273/183 A |
| 3,523,689 | 8/1970 | Cornell et al. | 273/195 R |
| 3,784,208 | 1/1974 | Weygandt | 273/183 A |
| 3,936,855 | 2/1976 | Scott | 273/195 B |
| 4,181,307 | 1/1980 | Krene et al. | 273/183 A |
| 4,516,780 | 5/1985 | Tabet | 273/202 |

*Primary Examiner*—William L. Freeh

[57] ABSTRACT

A swing stand for golf traning use includes: a first wedge leaf, a second wedge leaf and an intermediate wedge leaf pivotally secured with one another by a central hinge to form a collapsible board having the first and second leaves extended to form an upper sloping surface of which a slope of such an upper sloping surface can be adjusted by shifting the intermediate wedge leaf either rightwardly under the first leaf or leftwardly under the second leaf to variate the slope of the stand to simulate a rugged surface as found in a real golf course so as to enhance a golf playing skill and interest.

7 Claims, 5 Drawing Sheets

HEIGHT-ADJUSTABLE COLLAPSIBLE SWING STAND FOR GOLF TRAINING PURPOSE

BACKGROUND OF THE INVENTION

A conventional teeing board or ground as found in a golf driving range is usually made flat so that a golfer who practices the teeing operation can only play the drive on a flat board and can not simulate the real drive and swing motion as standing on rugged a golf course, thereby influencing the training or practicing efficiency for playing a golf.

The present inventor has found this drawback of a conventional teeing board of a training site and invented the present height-adjustable collapsible swing stand.

SUMMARY OF THE INVENTION

The object of the present invention is to provide a swing stand for golf training use including: a first wedge leaf, a second wedge leaf and an intermediate wedge leaf pivotally secured with one another by a central hinge to form a collapsible stand, wherein the first and second wedge leaves are extended to form an upper sloping surface of which a slope of such an upper sloping surface can be adjusted by shifting the intermediate wedge leaf either rightwardly or leftwardly to variate the slope of the stand to stimulate a rugged surface as found in a real golf course so as to enhance a golf playing skill.

DETAILED DESCRIPTION

Figure 1:
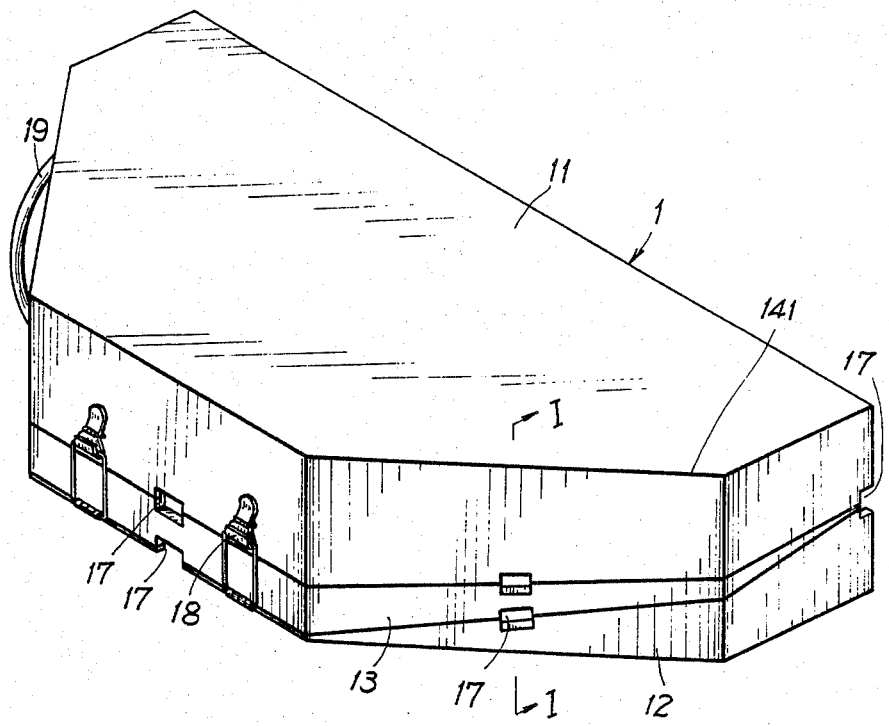
FIG. 1 is an illustration showing an assembled board in accordance with the present invention.
Figure 2:
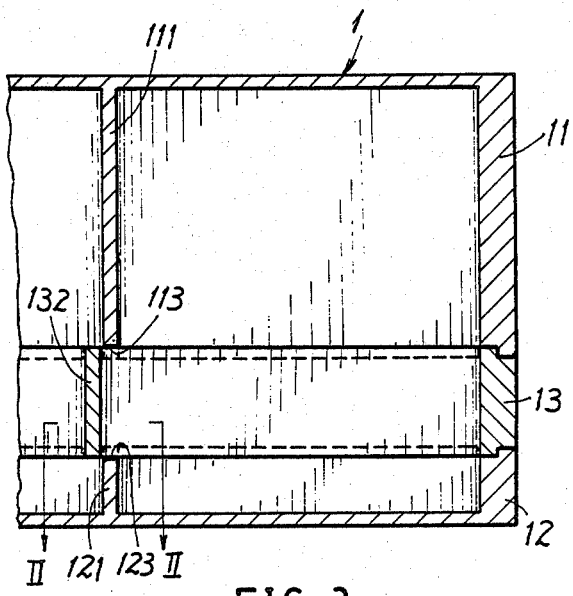
FIG. 2 is a partial sectional drawing when overlapping of the wedge leaves of the present invention as viewed from I—I direction of FIG. 1.

The present invention, as shown in FIGS. 1–10, comprises: a polygonal treading board 1 and an adjustable tee-peg means 2.

The polygonal treading board 1 includes: a first wedge leaf 11 shaped as a truncated wedge capable of rightward extension, a second wedge leaf 12 shaped as a wedge capable of leftward extension, and an intermediate wedge leaf 13 shaped as a wedge shiftable either rightwardly or leftwardly, all leaves pivotally secured with one another by a central hinge 10.

The first wedge leaf 11 includes an upper plate 110, a side frame 110*a*, a bottom surface 110*b* formed on a bottom edge of the leaf 11 and a reinforcing grating 111 formed under the upper plate 110 and disposed inside the side frame 110*a*. The grating 111 includes a plurality of cross portions 112 each having two recesses 113 respectively formed on two neighboring bars, forming a right angle with each other, of the cross portion 112.

Figure 6:
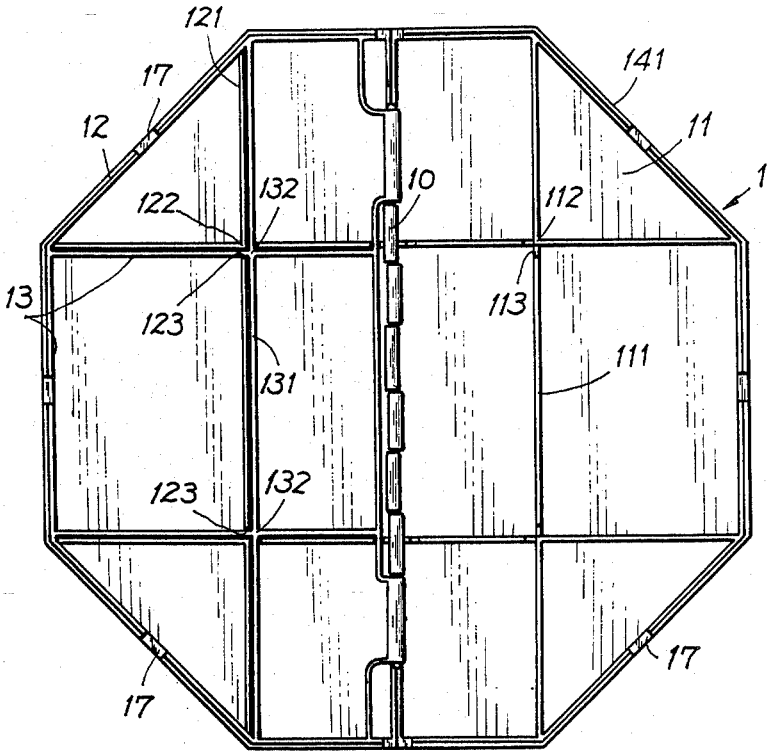
FIG. 6 is a bottom-view illustration of FIG. 5.
Figure 10:
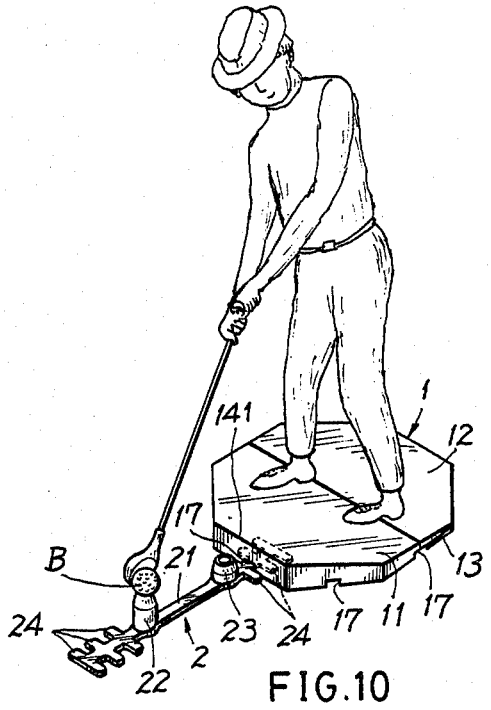
FIG. 10 is an illustration when hitting a golf ball of the present invention.

The second wedge leaf 12 includes an upper plate 120, a side frmae 120*a*, a bottom surface 120*b* formed on a bottom edge of the leaf 12, and a reinforcing grating 121 formed under the upper plate 120 and disposed inside the side frame 120*a*. The grating 121 includes plural cross portions 122 each having two recesses 123 respectively formed on two neighboring bars, forming a right angle with each other, of the cross portion 122. The upper plate 120 is coplanar to an upper surface of the upper plate 110 of first leaf 11 to form an upper sloping surface 14 of a polygonal shape having polygonal side edges such as octagonal edges 141 as shown in FIGS. 6 and 10, when extending the two leaves 11, 12 laterally. Each side frame 110*a* or 120*a* of each leaf 11 or 12 is formed with plural notches 17 along the bottom surface 110*b* or 120*b*, corresponding to each side edge 141 as shown in FIG. 10.

Figure 3:
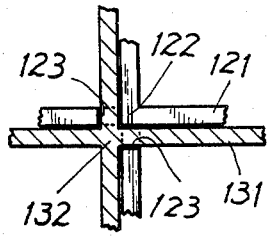
FIG. 3 is an illustration showing an intermediate wedge leaf engaged on a second wedge leaf as viewed from II—II direction of FIG. 2.
Figure 5:
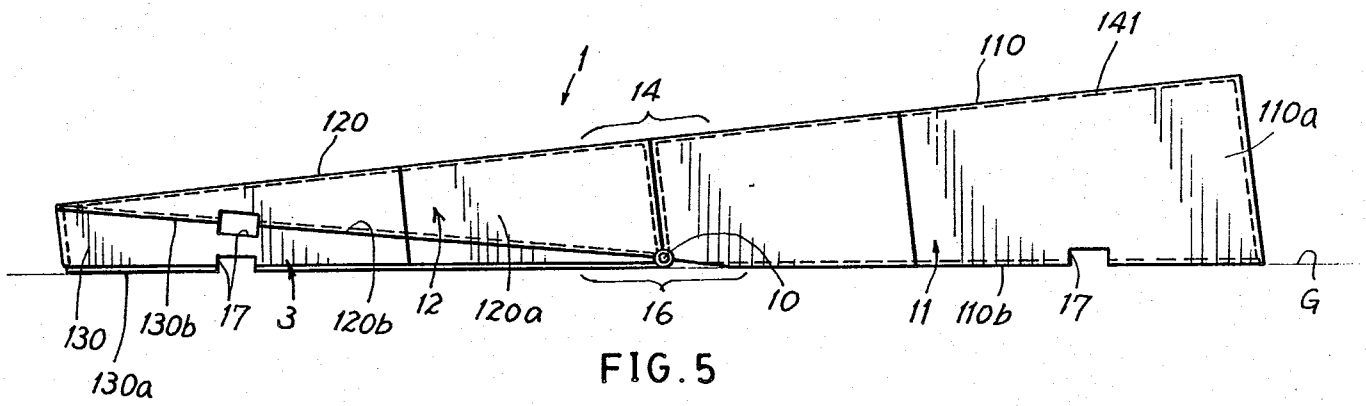
FIG. 5 is a side view of an extended treading board when shifting the intermediate leaf leftwardly.
Figure 4:
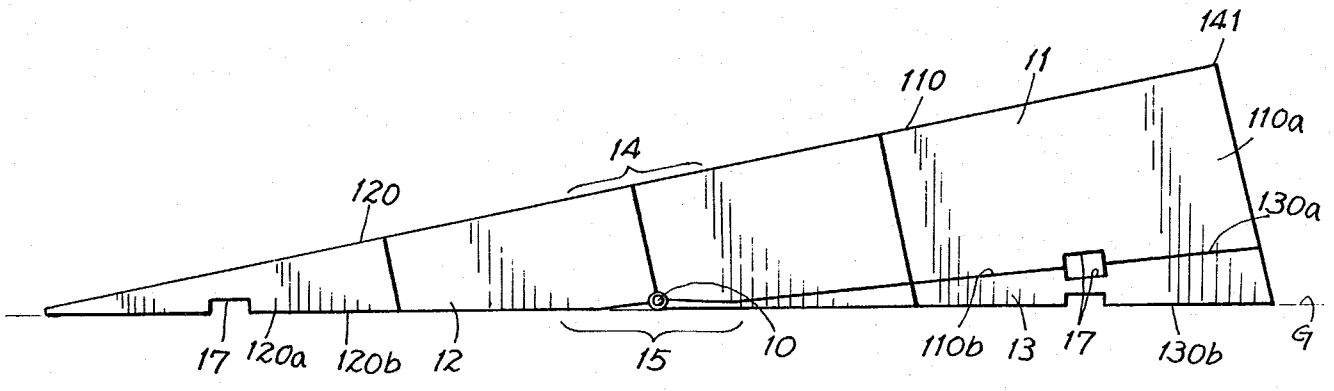
FIG. 4 is a side view of an extended treading board of the present invention when shifting the intermediate leaf rightwardly.

The intermediate wedge leaf 13 includes a side frame 130 having a first edge 130*a* and a second edge 130*b* tapered towards the central hinge 10 to form a wedge shape as shown in FIGS. 4 and 5, and a reinforcing grating 131 formed inside the frame 130 having plural grating cross portions 132 each operatively engaged with the two recesses 123 of the second leaf 12 or the two recesses 113 of first leaf 11 as shown in FIGS. 6, 4 and 3. Each grating cross portion 132 of the intermediate leaf 13 is engaged with either the two recesses 123 of the second leaf 12 or the other two recesses 113 of the first leaf 11 to enhance the stability of the treading board when treading the board 1 by a golfer as shown in FIG. 10.

The intermediate leaf 13 when shifting rightwardly around the hinge 10 to have its first edge 130*a* matching the bottom surface 110*b* of the side frame 110*a* of first leaf 11 and have its second edge 130*b* touching the ground level G as shown in FIG. 4, will have the second edge 130*b* of the leaf 13 to be coplanar to the bottom surface 120*b* of the second leaf 12 and the lowest periphery of the hinge 10 to form a general bottom surface 15 adapted for standing the treading board 1 on a ground level G and forming an upper sloping surface 14.

The first and second edges 130*a*, 130*b* are each formed with plural notches 17, each notch 17 disposed under each side edge 141 of the polygonal surface 14.

When shifting the intermediate leaf 13 leaftwardly around hinge 10 as shown in FIG. 5 to have its second edge 130*b* matching the bottom surface 120*b* of the second leaf 12 and have its first edge 130*a* touching the ground level G, the first edge 130*a* will be coplanar to the bottom surface 110*b* of first leaf 11 and the hinge 10 to form a general bottom surface 16 to stand treading board on the ground. The slope of the upper surface 14 as shown in FIG. 5 will be smaller than that of FIG. 4 to thereby adjust the slope of the treading board 1.

A fastener 18 is provided to fasten the second leaf 12 to the first leaf 11 by containing the intermediate leaf 13 as inserted between the two leaves 11, 12 as shown in FIG. 1. A handle 19 is formed on the side frame 110*a* of the first leaf for portable purpose when assembling the present device.

Figure 7:
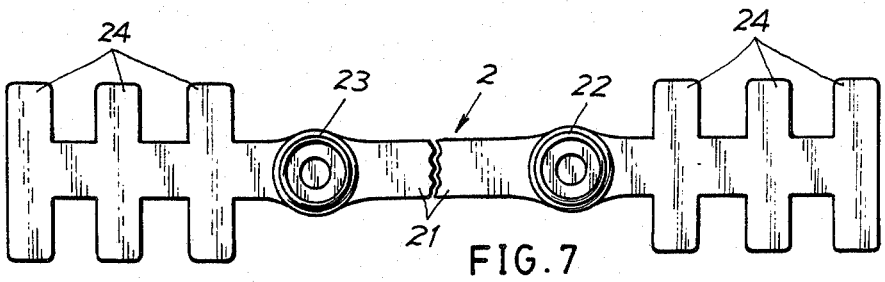
FIG. 7 shows an adjustable tee-peg means of the present invention.
Figure 8:
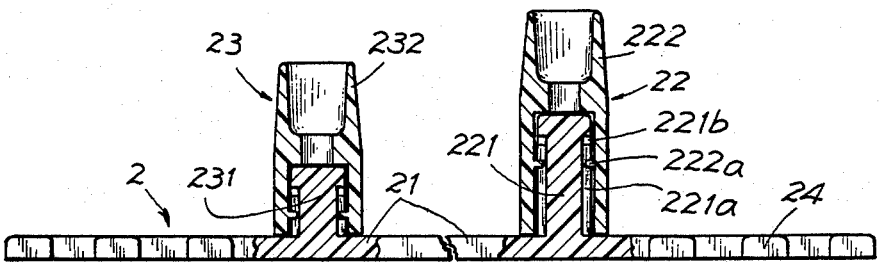
FIG. 8 is a side-view sectional drawing of the tee-peg means.
Figure 9:
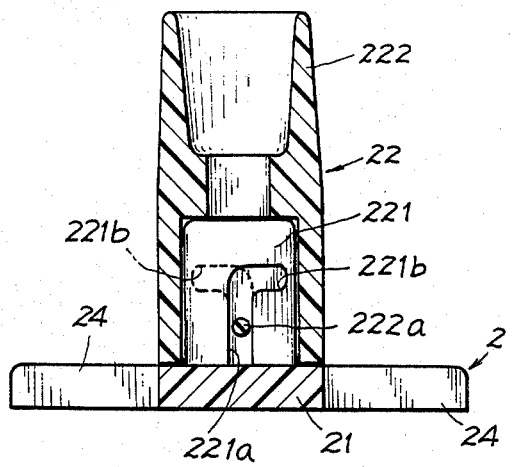
FIG. 9 is a sectional illustration of the peg means of the present invention.

The adjustable tee-peg means 2 as shown in FIGS. 7, 8 and 9 includes:

a longitudinal strip 21, a first peg portion 22 formed on one end portion of the strip for the placing of a golf ball on the peg portion 22, a second peg portion 23 formed on the other end portion of the strip 21, and a pair of groups of transverse strips 24 each group of strips 24 transversely formed on either end of the strip.

The first peg portion 22 includes a lower stem 221 having a vertical groove 221*a* formed on the stem and a horizontal groove 221*b* communicated with the upper end of the vertical groove 221*a*, and an upper cylinder 222 for holding a hitting ball B thereon having a latch extension 222*a* formed inside the cylinder 221 telescopically sliding along the vertical groove 221*a* and rotatively locking on the horizontal groove 221*b* to raise the upper cylinder for adjusting a higher position. The second peg portion 23 is similarly formed a lower stem 231 and an upper cylinder 232 telescopically mounting on the lower stem 231. The width of the longitudinal strip 21 is equal to the width of the notch 17 of treading board 1, whereas the length of each transverse strip 24 is longer than the width of the notch 17 so that the longitudinal strip 21 can be retractably or extendibly engaged with the notch 17 and is locked by the transverse strip 24 when pulling the strip 21 during a ball stroke. The height of the first peg portion 22 is different from that of the second peg portion 23, and each peg portion 22 or 23 can be telescopically adjusted its height by raising or lowering the upper cylinder 222 or 232 on the lower stem 221 or 231.

Figure 11:
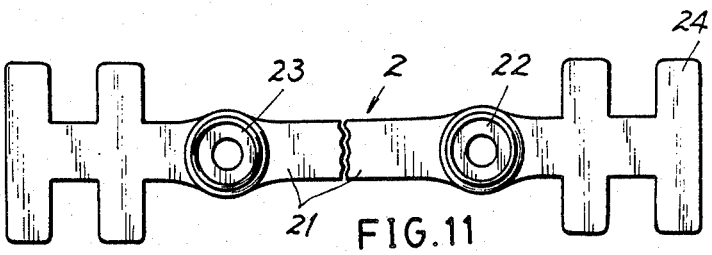
FIG. 11 shows another preferred embodiment of the peg means of the present invention.
Figure 12:
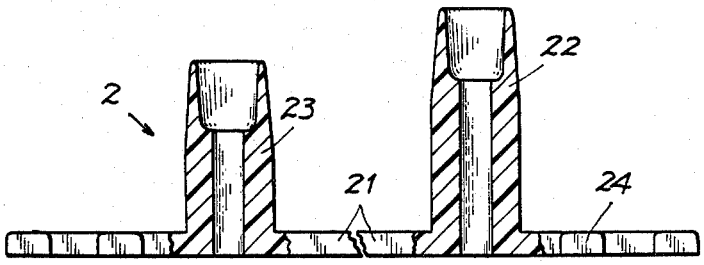
FIG. 12 is a side-view sectional drawing of FIG. 11.

Another preferred embodiment of the tee-peg means 2 of the present invention is shown in FIGS. 11 and 12 which is modified from the aforementioned by forming each peg portion 22 or 23 as a fixed type, not a telescopic type as aforesaid. The polygonal treading board 1 of the present invention is preferably a octagonal shape, but can also be modified as other suitable shapes.

Figure 13:
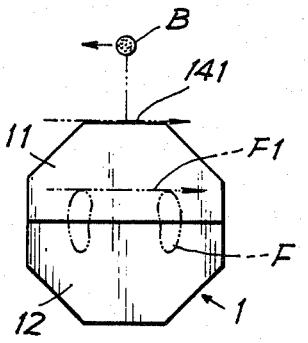
FIG. 13 is a top-view illustration showing a hitting application when placing the ball in front of the board.
Figure 14:
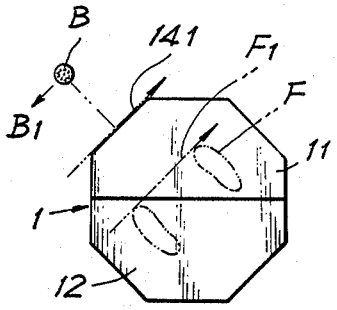
FIG. 14 shows a hitting application when placing the ball at an angle of 45 degrees leftwardly deviating from FIG. 13.
Figure 15:
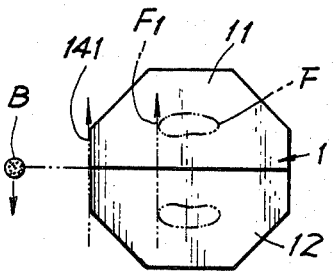
FIG. 15 shows a hitting application by further leftwardly deviating the ball 45 degrees from FIG. 14.

When practicing a driving or swing operation of a golf game as shown in FIG. 10, the golfer feet F can stand on the board 1 in a direction as shown in FIG. 13 whereby a hypothetic line F1 along the front ends of the golfer's feet F is set to be parallel to the front edge 141 and the ball B is placed on the peg portion 22 in front of the edge 141, the player will now play his golf to simulate the standing on a sloping golf-course surface to pose his toes to be higher than his heels. As shown in FIG. 14, the player's right foot will be higher than his left foot to simulate another rugged surface. In FIG. 15, still another sloping surface is formed to simulate another rugged golf course to thereby greatly spur a player's interest and enhance his hitting skill, accuracy or efficiency as meeting many areas such as: a teeing ground, a fairway, a bunker or a green arear, all having uneven surface.

When it is not in use, the leaves 11, 12, 13 of the present invention can be folded and locked by the fasteners 18 as shown in FIG. 1 for its convenient handling and storage. The number of the intermediate leaf 13 is not limited in this invention which can be modified to be plural leaves to variably adjust the height of the treading board 1 for its adjustable playing use.

I claim:

1. A collapsible swing stand for golf training purpose comprising:

a polygonal treading board including:

a first wedge leaf shaped as a truncated wedge having an upper plate, a side frame pertaining under the upper plate, and a reinforcing grating formed inside the side frame under the upper plate;

a second wedge leaf shaped as a wedge having an upper plate, a side frame pertaining under the upper plate of said second leaf, and a reinforcing grating disposed inside said side frame under said upper plate of said second leaf; and an intermediate wedge leaf shaped as a wedge having a side frame having a first edge operatively matching a bottom surface of the side frame of said first leaf and a second edge operatively matching a bottom surface of the side frame of said second leaf, both first and second edges of said intermediate leaf defining a wedge shape; said first, second and intermediate leaves pivotally secured with one another by a central hinge, said first and second leaves extendibly forming a treading board having an upper sloping surface coplanar to an upper surface of said first leaf and an upper surface of said second leaf, and said intermediate leaf shiftable either rightwardly to be under said first leaf or leftwardly to be under said second leaf to thereby adjust the slope of said upper sloping surface of said treading board; and an adjustable tee-peg means including:

a longitudinal strip having two peg portions of different heights respectively disposed on two end portions of said longitudinal strip and having a pair of groups of transverse strips each group of transverse strips transversely formed on either end of said longitudinal strip, said longitudinal strip retractably or extendibly secured under said treading board for adjusting a height of a golf ball placed on either said peg portion of said longitudinal strip.

2. A swing stand according to claim 1, wherein said treading board is an octagonal shape when laterally extending the first and second leaves.

3. A swing stand according to claim 1 wherein said peg portion of said adjustable tee-peg means includes a lower stem and an upper cylinder for placing a golf ball thereon, said upper cylinder telecopically mounting on said lower stem for adjusting a height of golf ball as placed on said upper cylinder.

4. A swing stand according to claim 1, wherein said treading board is formed with plural notches on a bottom surface of each side edge thereof, said notch having a width equal to a width of said longitudinal strip of said tee-peg means but smaller than a length of said transverse strip of said tee-peg means so that said longitudinal strip is secured under said treading board by limiting said transverse strip in said notch of said board.

5. A swing stand according to claim 1, wherein said reinforcing grating of either of said first or said second leaf is formed two recesses on two neighboring bars of a grating cross to engage with a corresponding grating cross of the intermediate leaf is so as to projectively juxtapose said grating cross of said intermediate leaf with said grating cross of either said first or second leaf to stabilize the leading board during a stroke operation.

6. A swing stand according to claim 1, wherein said intermediate leaf has its second edge coplanar to a bottom surface of said second leaf and said hinge to form a general bottom surface for standing said extended board on a ground level when said intermediate leaf shifted rightwardly to be under said first leaf.

7. A swing stand according to claim 1, wherein said intermediate leaf has it first edge coplanar to a bottom surface of said first leaf and said hinge to form a general bottom surface for standing said board on a ground level when said intermediate leaf shifted leftwardly to be under said second leaf.

* * * * *